United States Patent [19]

Yeski

[11] Patent Number: 4,535,322

[45] Date of Patent: Aug. 13, 1985

[54] SKI THEFT ALARM AND RUNAWAY SKI LOCATOR

[76] Inventor: Frederick R. Yeski, 23 Hughes St., Plainville, Conn. 06032

[21] Appl. No.: 519,258

[22] Filed: Aug. 1, 1983

[51] Int. Cl.[3] ..... G08B 21/00

[52] U.S. Cl. ..... 340/571; 280/809; 340/572

[58] Field of Search ..... 340/571, 573, 568; 280/809, 816

[56] References Cited

U.S. PATENT DOCUMENTS

| | | | |
|---|---|---|---|
| 3,781,861 | 12/1973 | Adler, Jr. et al. | 340/571 |
| 3,824,540 | 7/1974 | Smith | 340/571 |
| 4,279,433 | 7/1981 | Petaja | 340/571 |

*Primary Examiner*—Glen R. Swann, III

*Attorney, Agent, or Firm*—McCormick, Paulding & Huber

[57] ABSTRACT

A ski alarm and locator is provided and consists of a housing or molded embodiment of it mounted to the top surface of a ski, an audible signaling device within the housing, a power source within the housing, a remote switch with lockable jaws which via a cable connects the power source to the audible signaling device within the housing when the switch is closed, and a relay within the housing for connecting the power source to the audible signaling device when power to the relay is interrupted by cutting the cable disconnecting the remote switch.

4 Claims, 6 Drawing Figures

SKI THEFT ALARM AND RUNAWAY SKI LOCATOR

BACKGROUND OF THE INVENTION

The instant invention relates generally to skis and more specifically it relates to a ski alarm and locator.

When a person is skiing on deep powder snow or in a wooded area in winter it is difficult to locate a ski when the ski comes off a boot and either buries itself into deep powder snow or runs into the woods. Another problem is ski theft. When a skier removes and stores the skis when not in use, it is difficult to secure the skis. These situations are not desirable so, accordingly, they are in need of improvement.

SUMMARY OF THE INVENTION

A principle object of the present invention is to provide a ski alarm and locator that can sound an audible alarm so that a skier can find a ski when the ski becomes detached from a boot.

Another object is to provide a ski alarm and locator that can be used as a locking device and which reduces the likelihood of theft of the skis by sounding the alarm when a cable forming a part of the locking device is cut or unfastened.

An additional object is to provide a warning for the uphill skier of possible danger below, such as a fallen skier or a ski in the middle of a trail, also to warn of a runaway ski coming from above, a falling ski from a chair lift or a signaling device for ski patrol to find an injured skier.

A further object is to provide a ski alarm and locator that is simple and easy to use.

A still further object is to provide a ski alarm and locator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DETAILED DESCRIPTION OF THE PREFERRED EMBODIMENTS

Figure 1:
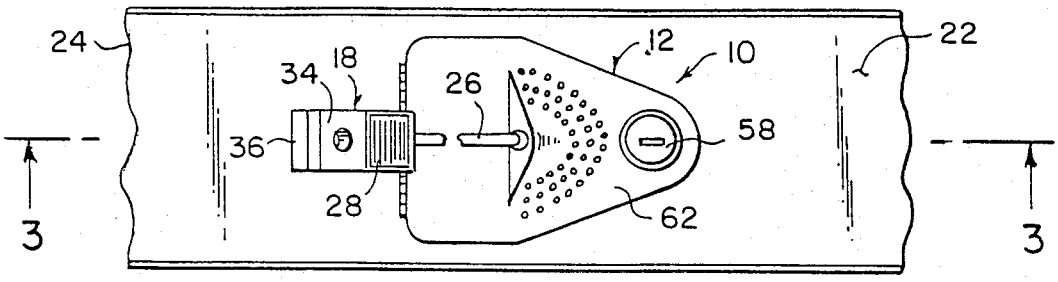
FIG. 1 is a top view of an alarm embodying the invention mounted on a ski.

Turning now descriptively to the drawings, in which similar reference characters denote smilar elements throughout the several views, FIGS. 1 through 4 illustrate a ski alarm and locator 10 that basically consists of a housing 12, an audible signaling device 14, a power source 16, a remote switch 18 with lockable jaws and a relay 20.

The housing 12 or molded embodiment of it is mounted to the top surface 22 of a ski 24 or binding with the audible signaling device 14 and power source 16 within the housing 12. The remote switch 18 via a cable 26 connects the power source 16 to the audible signaling device 14, within the housing 12, when the switch 18 is closed. The relay 20, within the housing 12, also connects the power source 16 to the audible signaling device 14 when power to the relay 20 is interrupted by cutting the cable 26 disconnecting the remote switch 18 (see FIG. 4).

Figure 2:
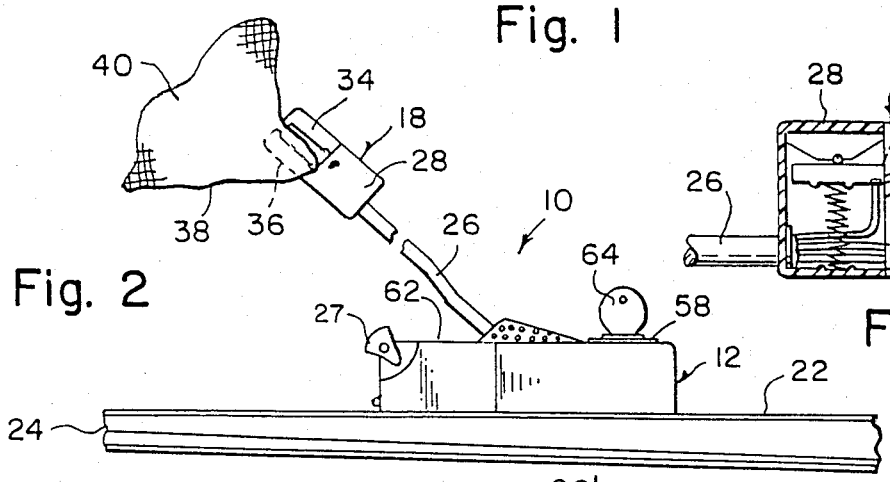
FIG. 2 is a side view of the alarm of FIG. 1.
Figure 2A:
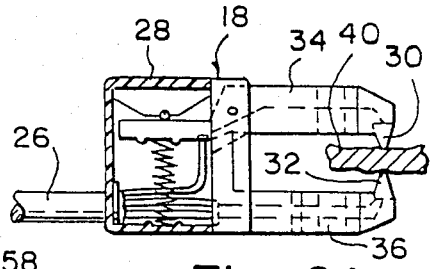
FIG. 2A is an enlarged side view partly in section of the clip of FIG. 1.

As best seen in FIG. 2A, the remote switch 18 is a spring closing clip 28 having a contact 30 and 32 on each jaw 34 and 36 of the clip 28. The jaws 34 and 36 of the clip 28 can be placed on a cuff 38 of a skier's pants 40 to keep the circuit to the signaling device 14 open until the ski 24 disengages from the skier's boot (not shown) pulling the jaws 34 and 36 off the cuff 38, allowing the contacts 30 and 32 to come together, closing the circuit and causing the audible signaling device 14 to activate so that the skier can locate the ski 24 in deep snow.

Figure 4:
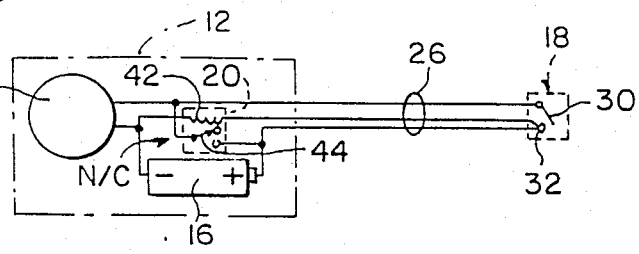
FIG. 4 is a schematic wiring diagram of the alarm of FIG. 1.

In FIG. 4 the relay 20 consists of a relay coil 42 activated by the power supply 16 and a relay arm 44. The relay arm 44 is in an open position between the power supply 16 and the audible signaling device 14 when energized. When power to the relay coil 42 is interrupted by disconnecting the remote switch 18, as by cutting the cable 26 to which the clip 28 is attached, the relay arm 44 will move to the closed (de-energized) position connecting the power supply 16 to the audible signaling device 14.

Figure 3:
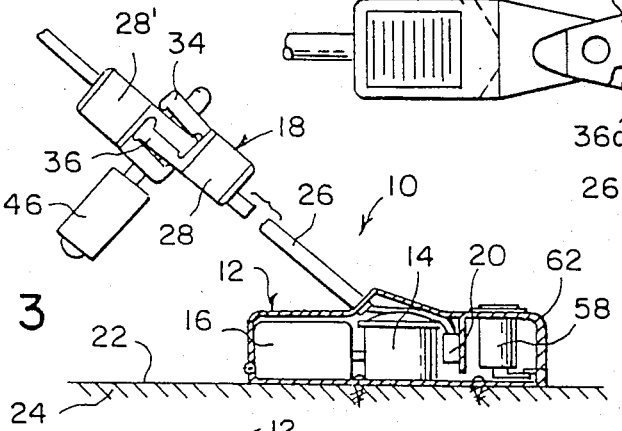
FIG. 3 is a cross-sectional view taken along line 3–3 in FIG. 1 showing the alarm used as a locking device.
Figure 3A:
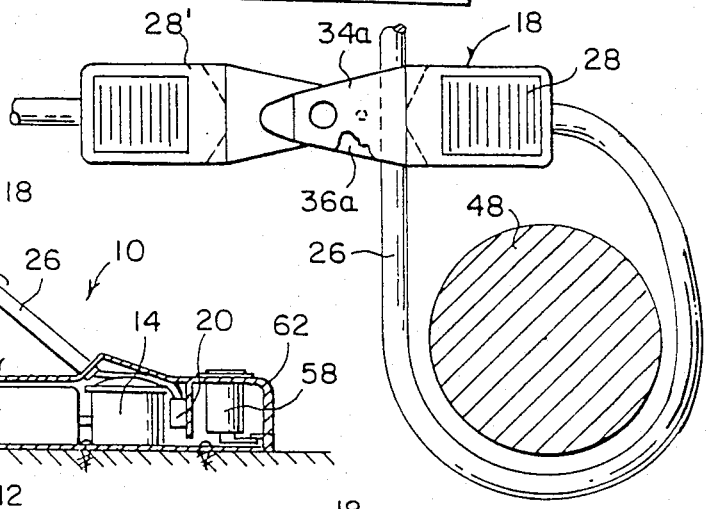
FIG. 3A is a top view partly in section showing the clips of two skis used in another way as a locking device.

The clip 28 can be used as a locking device to prevent theft of the ski 24. In FIG. 3 the clip 28 is engaged with the clip 28' of the other ski. A combination lock 46 is placed through apertures in the jaws of both clips 28 and 28' to prevent the separation of clips 28 and 28'. In FIG. 3A the cable 26 is wrapped around a pole 48 and through the jaws 34 and 36 of the clip 28. Clip 28 is then engaged with the other clip 28' to prevent removal of the skis from the pole 48. The clip 28 can also be passed through the loop or ring of the pole for complete locking of the equipment. If the device is not in use the jaws may be clipped to holder 27.

The audible signaling device 14 can be an electric bell, a buzzer or a siren. In this embodiment the audible signaling device 14 is an electric horn that has a decibel rating that can be heard under snow. The power source 16 is a battery. The battery is preferably a 9 volt or smaller type that is able to maintain its life for a few months, if not a season, under normal use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A ski alarm and locator which comprises:

(a) a housing for mounting to the top surface of a ski;

(b) an audible signaling device within the housing;

(c) a power source within the housing;

(d) a remote switch which, via a cable, connects the power source to the audible signaling device within the housing when the switch is closed; and (e) a relay within the housing for connecting the power source to the audible signaling device when power to the relay is interrupted by cutting the cable to disconnect the remote switch.

2. A ski alarm and locator as recited in claim 1, wherein the remote switch is a spring closing clip having a contact on each jaw of the clip so that the jaws of the clip can be placed on a cuff of a skier's pants to keep a circuit to said signaling device open until the ski disengages from the skier's boot pulling the jaws off the cuff, allowing the contacts to come together closing the circuit and causing the audible signal device to activate so that the skier can locate the ski in deep snow.

3. A ski alarm and locator as recited in claim 2, wherein the relay comprisies:

(a) a relay coil activated by the power supply; and (b) a relay arm in an open position between the power supply and the audible signaling device whereby when power to the relay coil is interrupted by cutting the cable to disconnect the clip, the relay arm will move to the closed (de-energized) position connecting the power supply to the audible signaling device so that the clip can be used as a locking device to prevent theft of the ski.

4. A ski alarm and locator as recited in claim 3, wherein the audible signaling device is an electric horn and the power source is a battery.

* * * * *